US006755235B1

(12) United States Patent
Nedic

(10) Patent No.: US 6,755,235 B1
(45) Date of Patent: Jun. 29, 2004

(54) QUICK-CHANGE LOCK ASSEMBLY FOR CASTING MACHINE FILL TUBES

(75) Inventor: Cedo Nedic, Ann Arbor, MI (US)

(73) Assignee: Hayes Lemmerz International, Inc., Northville, MI (US)

( * ) Notice: Subject to any disclaimer, the term of this patent is extended or adjusted under 35 U.S.C. 154(b) by 100 days.

(21) Appl. No.: 10/216,976

(22) Filed: Aug. 12, 2002

(51) Int. Cl.[7] ..... B22D 43/05
(52) U.S. Cl. ..... 164/335; 164/337; 164/292
(58) Field of Search ..... 164/133, 137, 164/292, 339, 119, 306, 307, 308, 309, 310, 335, 336, 337

(56) References Cited

U.S. PATENT DOCUMENTS 5,215,141 A 6/1993 Kuhn et al.

OTHER PUBLICATIONS

Hayes Lemmerz Equipment & Engineering, *Low Pressure Permanent Mold Casting Machines and Production Cells*, 1999, pp. 1–4.

CMI Equipment & Engineering, Inc., *High Production Permanent Mold Systems* . . . ., pp. 1–6.

*Primary Examiner*—Kiley Stoner
*Assistant Examiner*—Len Tran
(74) *Attorney, Agent, or Firm*—MacMillan, Sobanski & Todd, LLC

(57) ABSTRACT

A quick-change lock assembly is adapted to releasably attach a fill tube to a mold in a casting machine, the fill tube connecting a furnace of the casting machine to the mold. The casting machine preferably utilizes a Vacuum Riserless Casting/Pressure Riserless Casting (VRC/PRC) process. The lock assembly includes an upper ring that is adapted to be attached adjacent an aperture in a surface of the mold of the casting machine. The outer ring has inner and outer concentric surfaces. The lock assembly also includes a lower ring that also has inner and outer concentric surfaces. The inner surface of the lower ring is operable to receive a fill tube. The outer surface of the lower ring is operable to be releasably attached to the inner surface of the upper ring. The lower ring is releasably attached to the upper ring by a ramped portion on the inner surface of the upper ring that engages with a plurality of projection portions extending radially outwardly and axially upwardly from the outer surface of the lower ring. The upper ring is rigidly attached to the surface of the mold with a plurality of fasteners.

13 Claims, 5 Drawing Sheets

QUICK-CHANGE LOCK ASSEMBLY FOR CASTING MACHINE FILL TUBES

BACKGROUND OF THE INVENTION

The present invention relates generally to casting processes and, in particular, to a quick-change lock assembly for a casting machine fill tube, where the casting machine preferably utilizes a Vacuum Riserless Casting/Pressure Riserless Casting (VRC/PRC) process.

Casting machines utilizing various processes for producing casts from molds of molten metal such as aluminum to produce articles such as vehicle wheels and the like are well known. In traditional permanent mold processes, metal is melted and poured into a mold having a cavity disposed therein to form the casting. This traditional permanent mold process is disadvantageous because of poor and inconsistent cast quality. More recently, counter gravity casting processes, including low pressure permanent mold casting, have been utilized to improve the quality of the cast product. Counter gravity casting processes typically include a furnace for melting the metal, a mold for forming the cast product, and a riser providing a path for the molten metal to flow from the furnace to the mold. The furnace is typically located below the mold and the molten metal is forced from the furnace into the mold via pressurized gas or an electromagnetic pump.

Casting machines utilizing VRC/PRC processes are a more recent development and are an improvement upon low pressure permanent mold casting processes. As in low pressure permanent mold casting machines, the molten metal is pressurized into the mold but the VRC/PRC process also involves creating a vacuum in the mold cavity before forcing the molten metal into the mold. By creating a vacuum in the mold cavity, the number of risers needed for the casting process and thus the price for the casting machine is reduced. The VRC/PRC process also provides a cleaner and better quality casting than prior art low pressure permanent mold casting machines.

The risers, however, are not completely eliminated and there is a piping connection between the furnace and the mold, known in the art as a fill tube. The fill tubes are typically attached to the bottom surface of the mold with four bolts. Thermal expansions of the bolts are intended to decrease surface pressure between the gasket, the bottom of the mold, and the fill tubes. A typical prior art casting machine utilizing a VRC/PRC process for molten aluminum alloys uses titanium fill tubes. Because titanium fill tubes are very expensive and to reduce contamination of the fill tubes, the interior surface of the fill tube is protected by spraying or by dipping into a coating solution, such as a ceramic insert or the like.

Frequently, a fill tube needs to be replaced because of maintenance, wear, or detected leakage. Replacing the fill tube is an arduous procedure. Because of the heat of the casting process and other concerns, one person is required to hold one guiding device to ensure gasket positioning and align the flanges from below the mold, a second person is required to hold a preheat tube with a graphite gasket and align the flanges from above the mold, and a third person is required to secure the fill tube to the flanges by tightening the mounting bolts. Three workers, therefore, are required for this process. The removal of the fill tubes is very difficult. Often mounting bolts break, slowing the process. The time needed to connect one fill tube in prior art casting machines is approximately six minutes, while disconnecting one fill tube requires four minutes. These two operations combine to make a total of ten minutes of down time to change one fill tube.

It is desirable, therefore, to reduce the amount of time required to connect and disconnect the fill tube for a casting machine utilizing a VRC/PRC process.

SUMMARY OF THE INVENTION

The present invention concerns a quick-change lock assembly for releasably attaching a fill tube to a mold in a casting machine. Preferably, the casting machine utilizes a Vacuum Riserless Casting/Pressure Riserless Casting (VRC/PRC) process. The fill tube connects a furnace of the casting machine to the mold. The lock assembly includes an upper ring that is adapted to be attached adjacent an aperture in a surface of the mold of the casting machine. The outer ring has inner and outer concentric surfaces. The lock assembly also includes a lower ring that also has inner and outer concentric surfaces. The inner surface of the lower ring is operable to receive a fill tube. The outer surface of the lower ring is operable to be releasably attached to the inner surface of the upper ring. The lower ring is releasably attached to the upper ring by a ramped portion on the inner surface of the upper ring that engages with a plurality of projection portions extending radially outwardly and axially upwardly from the outer surface of the lower ring. The upper ring is rigidly attached to the surface of the mold with a plurality of fasteners.

In operation, the upper ring is attached to the surface of the mold by a plurality of fasteners and the fill tube is received by the inner surface of the lower ring. The lower ring and the fill tube, when attached, form a tube assembly. The lower ring is then attached to the inner surface of the upper ring, the fill tube extends through the aperture into the mold and the lower ring seals the fill tube to allow molten material to flow from the furnace and though the fill tube into the mold without leaking. The quick-change lock assembly advantageously prevents air from entering mold cavity and prevents molten material from leaking outside the fill tube. Preferably, a gasket is interposed between a sealing surface of the mold and an upper surface of the fill tube. Preferably, another gasket is interposed between an upper portion of the inner surface of the lower ring and another surface of the fill tube. The gaskets are preferably composed of graphite or similar sealing material. Alternatively, the gaskets are a wave spring type gasket.

During operation of the casting machine, the fill tube will need to be changed due to the inevitable development of leaks because of gasket failure and the like. The tube assembly is replaced by first preheating the assembly to a predetermined temperature, preferably 400 degrees Fahrenheit. Prior to connecting this tube assembly the bottom of the mold is preheated to a predetermined temperature, preferably 800 degrees Fahrenheit. The tube assembly is then attached to the lower surface of the mold by turning the assembly in an engaging direction.

The quick-change lock assembly in accordance with the present invention solves several important problems in prior art casting machines utilizing the VRC/PRC process. The assembly provides even gasket compression by utilizing the geometry of the ramped portions. The lock assembly also accepts deviation caused in machining tubes, which are within the tolerance field. Furthermore, the design of the present invention advantageously requires only one person to connect and disconnect the fill tubes. The one person can change a fill tube in a reduced time of approximately four minutes, compared to ten minutes and three workers required in the prior art. In operation, the assembly in accordance with the present invention has reduced the average downtime per day by half, has reduced the average number of tube failures per day by over half and has increased the number of cast products produced per tube by four times.

The quick-change lock assembly of the present invention requires fewer maintenance workers to change a fill tube, reduces down time when an assembly needs to be changed, and provides a measurable cost savings because fewer and quicker changes result in less fill tubes being utilized and more time available to produce the cast product.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
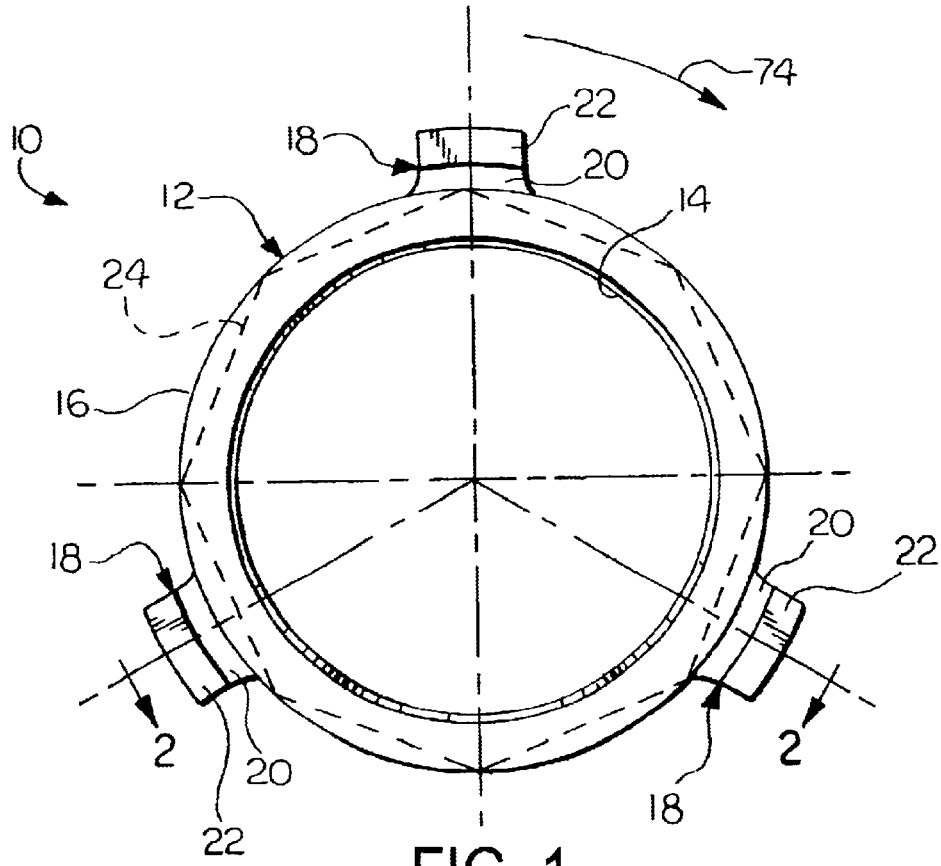
FIG. 1 is a top view of a lower ring of a quick-change lock assembly in accordance with the present invention.
Figure 2:
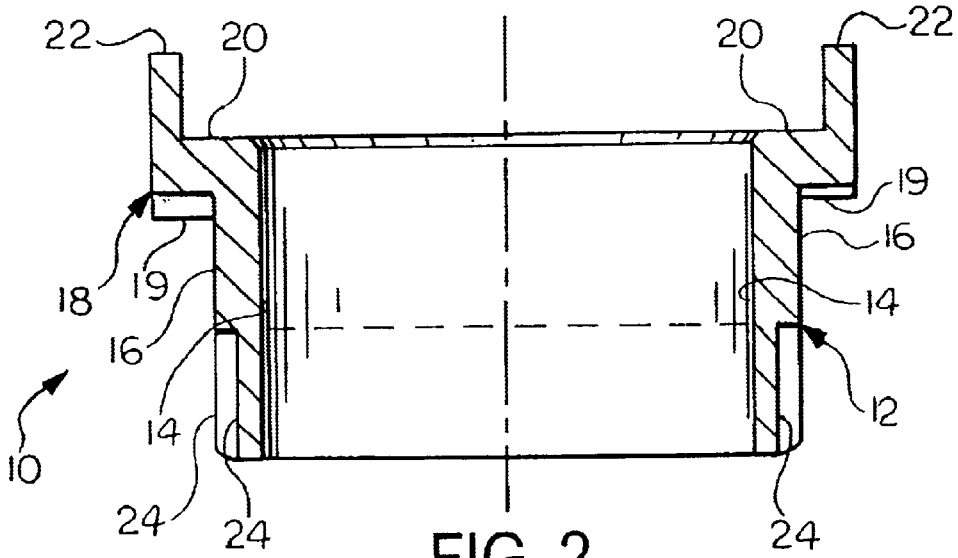
FIG. 2 is a cross-sectional view taken along the line 2—2 of the lower ring in FIG. 1.
Figure 7:
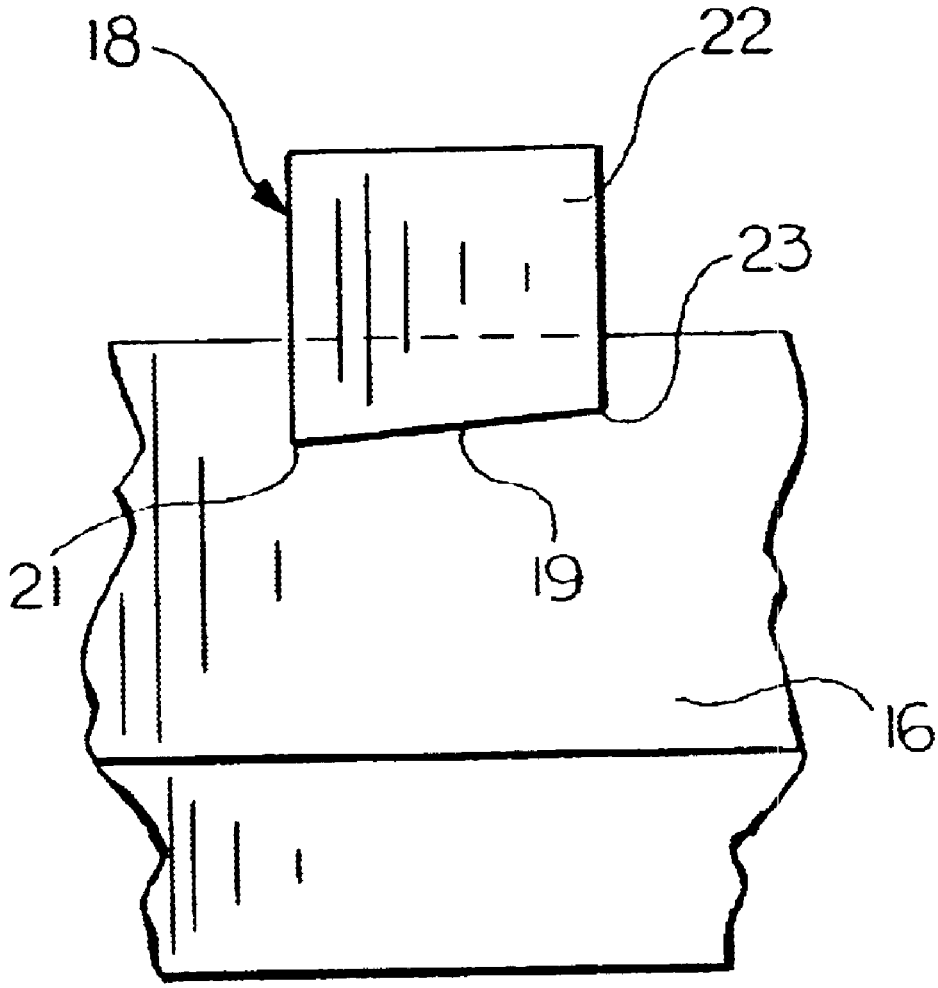
FIG. 7 is a fragmentary view of the flange portion of the lower ring shown in FIG. 1.

Referring now to FIGS. 1 and 2, a lower ring for use in a quick-change lock assembly in accordance with the present invention is indicated generally at 10. The lower ring 10 includes a ring body 12 having an inner surface 14 and an outer surface 16. The inner 14 and outer 16 surfaces are concentric. A plurality of projections or flanges 18 each having a radially outwardly extending portion 20 and an axially upwardly extending portion 22 extend from an upper portion of the ring body 12. Preferably, the flanges 18 are spaced equidistantly along the circumference of the outer surface 16 of the ring body 12. A lower portion 24 of the outer surface 16 is machined to an octagonal shape to accommodate a torque wrench (not shown) or the like. Alternatively, the lower portion 24 is machined to a hexagonal shape or any other shape operable to accommodate a wrench or similar device. Each of the outwardly extending portions 20 of the flanges 18 includes a lower surface 19 (best seen in FIG. 7) that is ramped from a first end 21 to a second end 23 for engaging an upper ring in the quick-change lock assembly, outlined in more detail below.

Figure 3:
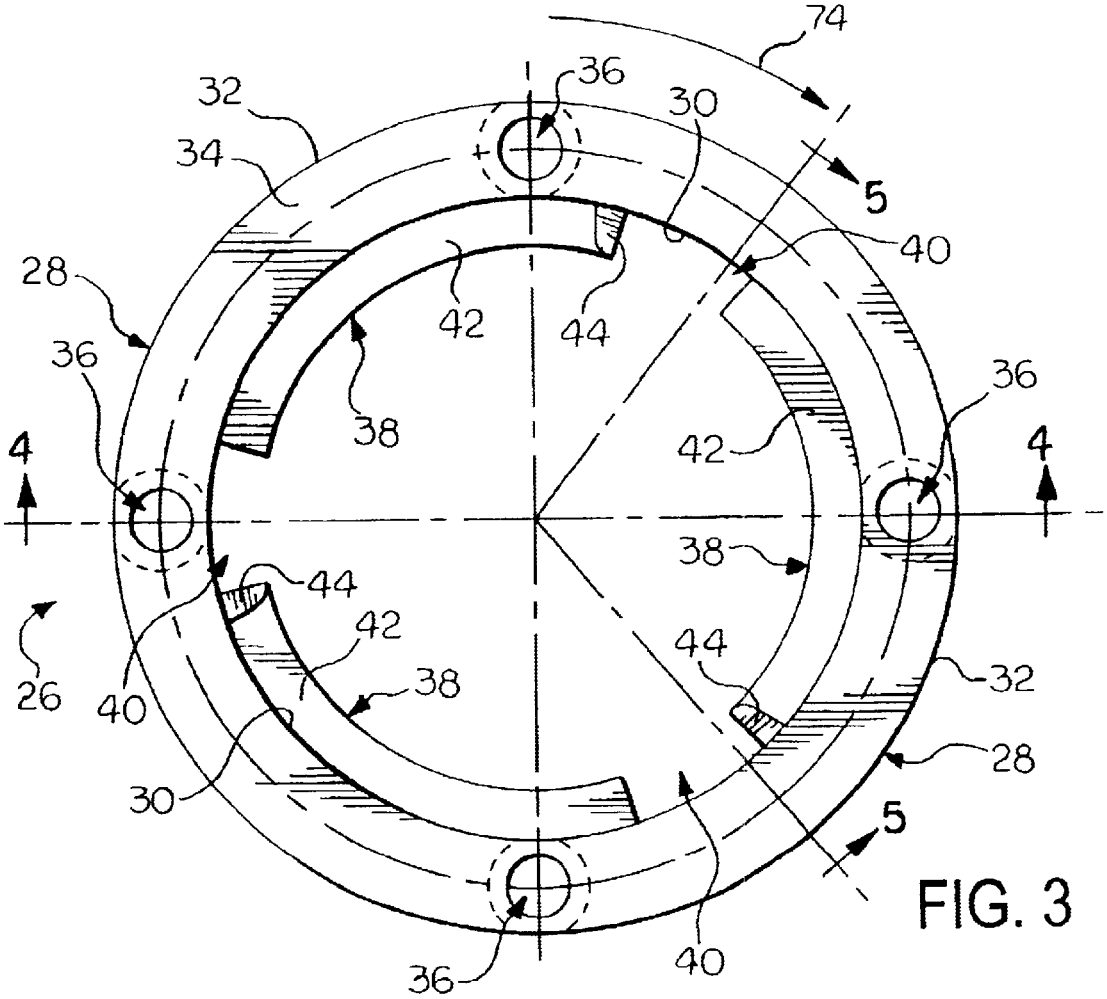
FIG. 3 is a bottom view of an upper ring of a quick-change lock assembly in accordance with the present invention
Figure 4:
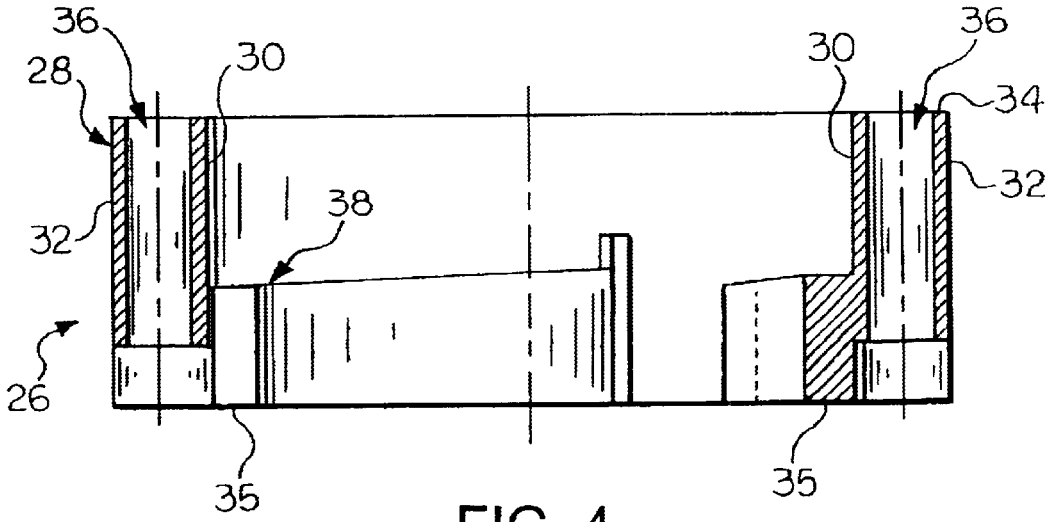
FIG. 4 is a cross-sectional view taken along the line 4—4 of the upper ring in FIG. 3.
Figure 5:
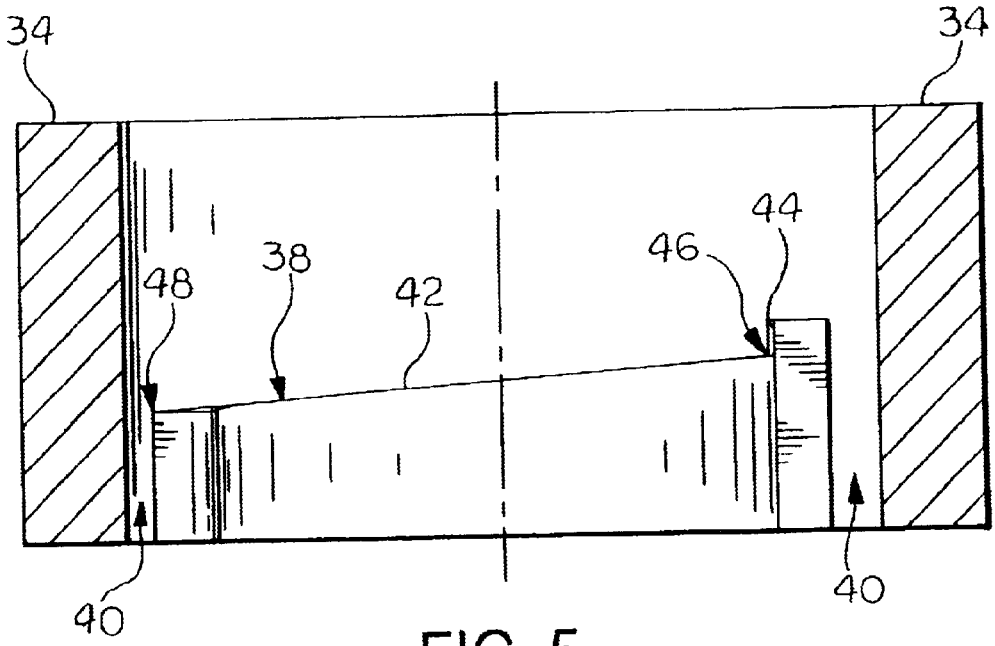
FIG. 5 is an enlarged cross-sectional view taken along line 5—5 of the upper ring in FIG. 3.

Referring now to FIGS. 3, 4, and 5, an upper ring for use in a quick-change lock assembly in accordance with the present invention is indicated generally at 26. The upper ring 26 includes a ring body 28 having an inner surface 30 and an outer surface 32. The inner 30 and outer 32 surfaces are concentric. The upper ring body 28 includes an upper surface 34 and a lower surface 35 having a plurality of bolt holes 36 extending therethrough. A plurality of engagement surfaces 38 each extend inwardly from a lower portion of the inner surface 30. The engagement surfaces 38 are separated by a plurality of gaps 40. Preferably, the gaps 40 are spaced equidistantly along the circumference of the inner surface 30 of the ring body 28. Each of the engagement surfaces 38 includes an upper surface 42 having a stop member 44 extending upwardly from an end 46 thereof. Each of the upper surfaces 42 of the engagement surfaces 38 is ramped from another end 48 adjacent one of the gaps 40 to the end 46 adjacent the stop member 44, best seen in FIG. 5.

Figure 6:
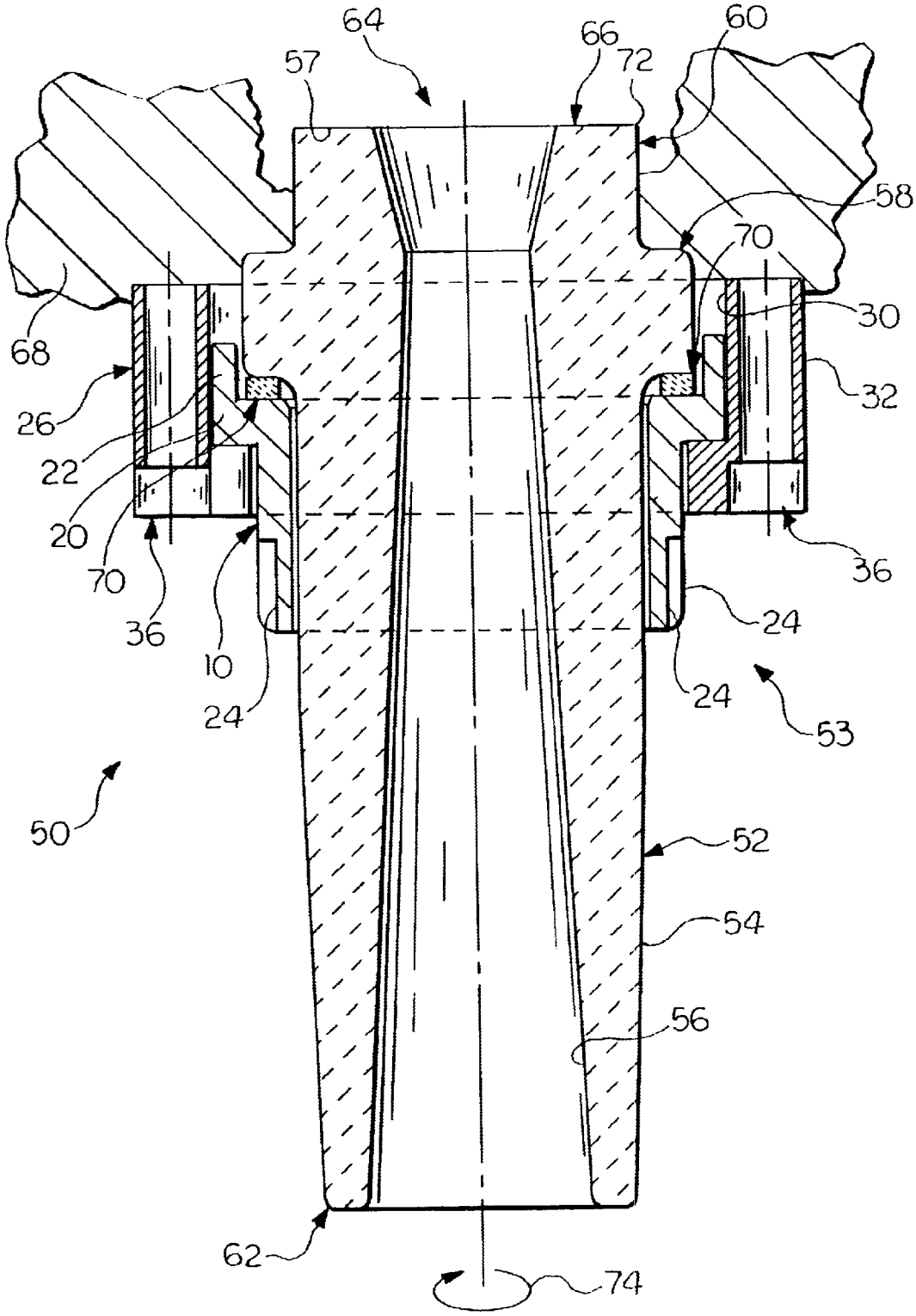
FIG. 6 is a cross-sectional view of a quick-change lock assembly in accordance with the present invention.

Referring now to FIG. 6, a quick-change lock assembly in accordance with the present invention is indicated generally at 50. The lock assembly 50 includes the lower ring 10, the upper ring 26, and an elongated fill tube 52 having an outer surface 54 and an inner surface 56. A flange 58 extends outwardly from the outer surface 54 of the fill tube 52 intermediate an upper end 60 and a lower end 62. The fill tube 52 to be used with the lock assembly 50 in accordance with the present invention is preferably composed of an aluminum titanate ceramic material, the production price of which is much lower than that of the titanium fill tubes (not shown) of the prior art. The aluminum titanate ceramic material of the fill tube 52 advantageously provides high thermal shock resistance, low thermal expansion coefficient, low Young's modulus, good thermal insulation, good non-wetting behavior, as well as corrosion resistance.

The upper ring 26 is adapted to be attached adjacent an aperture 64 in a surface 66 of a mold 68 of a casting machine (not shown). The casting machine preferably utilizes a Vacuum Riserless Casting/Pressure Riserless Casting (VRC/PRC) process. Preferably, the upper ring 26 is attached to the surface 66 of the mold 68 by a plurality of fasteners (not shown) such as a bolt or the like extending through an associated bolt hole 36 into the surface 66.

The inner surface 14 of the lower ring 10 is adapted to receive the fill tube 52 adjacent the upper end 60 of the fill tube 52. The lower ring 10 and the fill tube 52, when attached, form a tube assembly, indicated generally at 53. Prior to the lower ring 10 receiving the fill tube 52, a first gasket 70 is interposed between a lower surface of the flange 58 and an upper surface of the outward portion 20 of the lower ring 10. A second gasket 72 is attached adjacent an upper surface 57 of the fill tube 52. The gaskets 70 and 72 are preferably composed of graphite or similar sealing material. Alternatively, the gaskets 70 and 72 are a wave spring type gasket. The outer surface 16 of the lower ring 10 is operable to be releasably attached to the inner surface 30 of the upper ring 26. The flanges 18 of the lower ring 10 extend into the gaps 40 of the upper ring 26. After being inserted into the upper ring 26, the lower ring 10 is rotated in an engaging direction 74, best seen in FIGS. 1, 3, and 6, where the lower surfaces 19 of the outward portions 20 of the flanges 18 engage with the upper surfaces 42 of the engaging projections 38. The lower ring 10 is rotated until an outer surface of the outward portions 20 of the flanges 18 engage with the stop members 44 of the engaging projections 38. By being rotated in the engaging direction 74, the ramped lower surfaces 19 of the outward portions 20 of the lower ring 10 travel along the ramped upper surface 42 of the engaging members 38 and raise the tube assembly 53 a distance equal to the vertical distance of the ramped upper surfaces 42. When the tube assembly 53 is raised, the first gasket 70 is compressed between the lower surface of the flange 58 and the upper surface of the outward portion 20 of the lower ring 10 and the second gasket 72 is compressed between the upper surface 57 of the fill tube 52 and the surface 66 in the mold 68.

After the lower ring 10, upper ring 26, and the fill tube 52 are connected to form the lock assembly 50, the upper end 60 of the fill tube 52 extends through the gap 64 into the mold. The lower end 62 of the fill tube 52 extends into a furnace (not shown) to connect the furnace to the mold 66 at the upper end 60. The compressed gaskets 70 and 72 seal the fill tube 52 to allow molten material (not shown) to flow from the furnace and though the lower end 62 to the upper end 60 of the fill tube 52 into the mold 68 without leaking.

After the lock assembly 50 is attached to the surface 66 of the mold 68, conductive heat transfer from the mold 68 to the quick change lock assembly 50 will provide additional thermal expansions of the lock assembly 50. The heat transfer from the mold 68 to the lock assembly 50 causes the lock assembly 50 to expand along the longitudinal axis of the fill tube 52 toward the gaskets 70 and 72, which increases the surface pressure on the gaskets 70 and 72. The thermal expansion reduces the possibility that air will gain entry into the mold cavity 64 or that the molten material will escape the fill tube 52, and allows the lower ring 10 to remain attached to the upper ring 26. In addition, frictional forces between the lower surfaces of the outward portions 20 of the flanges 18 and the upper surfaces 42 of the engaging projections 38 assist in retaining the lower ring 10 to the upper ring 26. The frictional forces between the lower surfaces of the outward portions 20 of the flanges 18 and the upper surfaces 42 of the engaging projections 38 are increased by providing a torque to the lower portion 24 of the outer surface 16 of the lower ring 10 when the lower ring 10 is connected to the upper ring 26.

A method for installing a fill tube 52 utilizing a quick change lock assembly 50 according to the present invention may be practiced by first removing a previously installed tube assembly 53, preferably by rotating the lower ring 10 in a direction opposite the engaging direction 74, such as by a torque wrench or the like. A second tube assembly 53 to be installed is then pre-heated to a first predetermined temperature, preferably about 400 degrees Fahrenheit and the surface 66 of the mold 68 is pre-heated to a second predetermined temperature, preferably about 800 degrees Fahrenheit. The tube assembly 53 to be installed is then attached to the surface 66 of the mold 68 as outlined above by engaging the lower ring 10 and fill tube 52 with the upper ring 26.

In a preferred embodiment, the upper surfaces 42 of the engaging projections 38 of the upper ring 26 are ramped at a three degree incline from the end 48 adjacent one of the gaps 40 to the end 46 adjacent the stop member 44. The lower surfaces 19 of the outward portions 20 of the flanges 18 are ramped at a three degree incline from the first end 21 to the second end 23. In order to provide an exact compression force on the gaskets 70 and 72, a moment wrench (not shown) is attached to the lower portion 24 of the lower ring 10 and turned in the engaging direction 74 to provide a torque on the tube assembly 53. Moving the lower surface 19 of the outward portion 20 of the flange 18 on the ramped surface 42 with a three degree incline will raise the entire tube assembly 53 about 0.5 mm. To compress the gaskets 70 and 72 to 0.5 mm, a moment torque of about 45–50 lb-ft is applied to the lower portion 24 of the lower ring 10.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A quick-change lock assembly for releasably attaching a fill tube to a mold in a casting machine, the fill tube connecting a furnace to the mold, said assembly comprising:

an upper ring adapted to be attached adjacent an aperture in a surface of the mold of the casting machine, said outer ring having an inner surface and an outer surface, said inner and outer surfaces of said upper ring being concentric; and a lower ring having an inner surface and an outer surface, said inner and outer surfaces of said lower ring being concentric, said inner surface of said lower ring adapted to receive a fill tube, said outer surface of said lower ring adapted to be releasably attached to said inner surface of said upper ring, whereby when said upper ring is attached to the surface of the mold, the fill tube is received by said inner surface of said lower ring and said lower ring is attached to said inner surface of said upper ring and the fill tube extends through the aperture into the mold, said lower ring seals the fill tube to allow molten material to flow from the furnace and through the fill tube into the mold without leaking.

2. The assembly according to claim 1 wherein said lower ring is releasably attached to said upper ring by a ramped portion on said inner surface of said upper ring that engages with a plurality of ramped projection portions extending radially outwardly and axially upwardly from said outer surface of said lower ring.

3. The assembly according to claim 1 wherein a portion of said outer surface of said lower ring is octagonal.

4. The assembly according to claim 1 wherein said upper ring is rigidly attached to the surface of the mold with a plurality of fasteners.

5. A lock assembly for use in a casting machine, comprising:

an upper ring adapted to be attached adjacent an aperture in a surface of a mold of a casting machine, said outer ring having an inner and an outer surface;

a lower ring having an inner and an outer surface, said outer surface of said lower ring adapted to be releasably attached to said inner surface of said upper ring; and a fill tube having an outer surface, said outer surface of said fill tube adapted to be received by said inner surface of said lower ring, whereby when said upper ring is attached to the housing of the casting machine, said inner surface of said lower ring receives said fill tube and said lower ring is attached to said inner surface of said upper ring and said fill tube extends through the aperture into the mold, said lower ring seals said fill tube to allow molten material to flow from the furnace and through said fill tube into the mold without leaking.

6. The assembly according to claim 5 wherein said lower ring is releasably attached to said upper ring by a ramped portion on said inner surface of said upper ring that engages with a plurality of ramped projection portions extending radially outwardly and axially upwardly from said outer surface of said lower ring.

7. The assembly according to claim 6 wherein three projections extend radially outwardly and axially upwardly from said outer surface of said lower ring.

8. The assembly according to claim 5 wherein said outer surface of said lower ring is octagonal.

9. The assembly according to claim 5 wherein said upper ring is rigidly attached to the surface of the mold with a plurality of fasteners.

10. The assembly according to claim 5 including a gasket interposed between an upper portion of said fill tube and a sealing surface of the mold housing.

11. The assembly according to claim 5 including a gasket interposed between a portion of said fill tube and a sealing surface of said inner diameter of said lower ring.

12. The assembly according to claim 11 wherein said gasket is a one of a graphite gasket and a wave spring gasket.

13. The assembly according to claim 5 wherein said fill tube is constructed of aluminum titanate.

* * * * *